United States Patent [19]

Wetzel

[11] Patent Number: 4,667,580

[45] Date of Patent: May 26, 1987

[54] CLEAN ROOM MODULE

[76] Inventor: Lawrence E. Wetzel, 3590 Watervale Rd., Manlius, N.Y. 13104

[21] Appl. No.: 841,674

[22] Filed: Mar. 19, 1986

Related U.S. Application Data

[63] Continuation-in-part of Ser. No. 632,599, Jul. 19, 1984, abandoned.

[51] Int. Cl.[4] ..... F24F 1/02

[52] U.S. Cl. ..... 98/34.6; 52/282; 165/16; 165/57; 165/108

[58] Field of Search ..... 98/1.5, 31.5, 31.6, 98/33.1, 34.5, 34.6, 36; 55/385 A; 165/16, 22, 31, 38, 57, 108; 52/272, 275, 278, 279, 281, 282

[56] References Cited

U.S. PATENT DOCUMENTS

| | | | |
|---|---|---|---|
| 1,670,656 | 5/1928 | Fleisher | 98/34.6 X |
| 1,749,763 | 3/1930 | Fleisher | 98/34.6 X |
| 2,091,562 | 8/1937 | Palmer | 98/34.6 |
| 2,160,225 | 5/1939 | Newman | 52/281 X |
| 2,898,836 | 8/1959 | Lockheed . | |
| 3,158,457 | 11/1964 | Whitfield | 55/385 A X |
| 3,402,654 | 9/1968 | Berst | 98/1.5 |
| 3,487,766 | 1/1970 | Wood | 98/31.5 |
| 3,505,989 | 4/1970 | Truhan | 55/385 A X |
| 4,427,427 | 1/1984 | DeVecchi | 55/385 A X |
| 4,477,263 | 10/1984 | Shaver et al. | 55/385 A X |
| 4,491,061 | 1/1985 | Nishizawa et al. | 98/34.6 |
| 4,549,472 | 10/1985 | Endo et al. | 98/31.5 |

*Primary Examiner*—Harold Joyce
*Attorney, Agent, or Firm*—Bruns and Wall

[57] ABSTRACT

A pre-assembled, self-contained clean room module having everything necessary for maintaining the cleanliness, temperature, humidity and pressurization required for the work space within the room. Because the module is factory built rather than built on site, precise quality control can be achieved and each module can be thoroughly tested before shipment. The module is provided with its own sealed base unit which permits it to be moved or relocated without having to be disassembled, and also insures that the module will have a completely sealed sump area beneath its floor. The module is also provided with its own self-contained air conditioning unit which has two independent air systems or paths whereby only a portion of the recirculating air need be conditioned.

13 Claims, 13 Drawing Figures

34
16
35
25
25
18
24
17
36
20
22
40
21
38
41
47
25
61
32
28
15
31
26
30
27
32
27
32

61
44
45
42
48
57
55
55
54
56
51
47
52
50
27
21
32
15
26
32

34
16
35

18
22
17
25
27
15
32
26
32

34
46
35
44
45
16
21
58

57
48
25
54
49
20
60
27
15
32
58
32

21
21
64
64
15
32
32

34
16
35
24
17
24
61
20
18
15
32
26
27
32

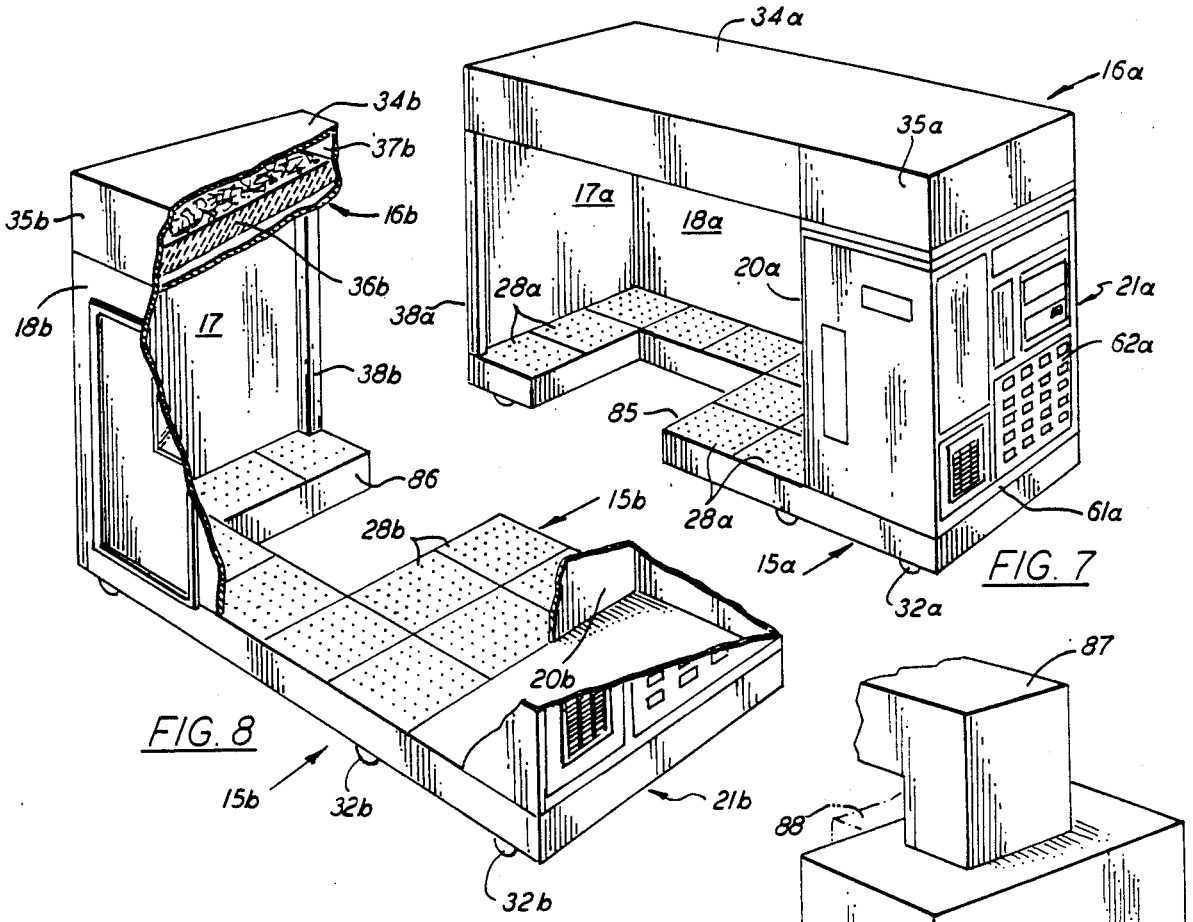
FIG. 7
FIG. 8
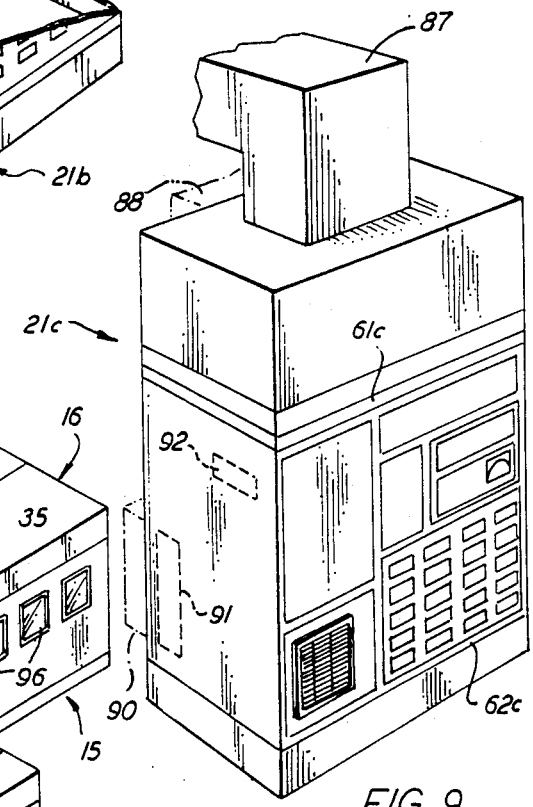
FIG. 9
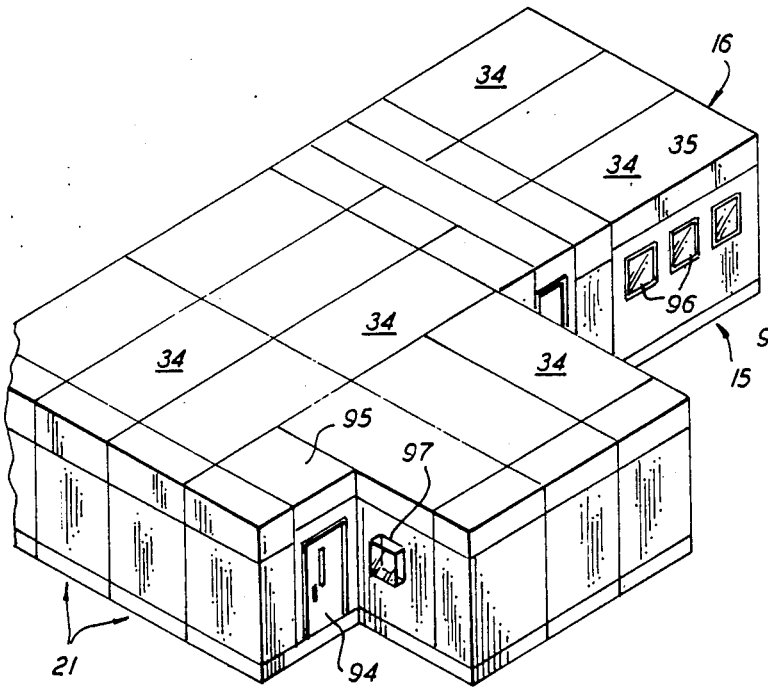
FIG. 10

CLEAN ROOM MODULE

This is a continuation-in-part of co-pending application Ser. No. 632,599 filed on July 11, 1984 now abandoned.

BACKGROUND OF THE INVENTION

This invention relates generally to controlled environment chambers, and has particular reference to an improved construction for a clean room module.

With the growth of high technology industries, the need for contamination free work areas has greatly increased. This has led to the development of completely enclosed work areas, known as clean rooms, in which the environment is closely controlled to rid the ambient air of contaminants. Heretofore, most clean rooms have been built on site and this had led to inefficiencies and other problems.

More recently, modular type clean rooms have been developed wherein the principal components of the room are prefabricated at the factory and then are assembled on site. The modular constructions are more efficient and have fewer problems than the completely on site constructions but some problems do remain. An example of a modular type clean room is disclosed in U.S. Pat. No. 4,409,889, issued Oct. 18, 1983 to M. L. Burleson. A prefabricated knockdown clean room is disclosed in U.S. Pat. No. 4,267,769, issued May 19, 1981 to G. B. Davis et al. These two patents represent the closest prior art known to the applicant.

Other patents noted in a preliminary search are U.S. Pat. Nos. 2,559,654; 3,505,989; 3,601,031; 3,766,844; 4,044,772 and 4,202,676.

SUMMARY OF THE INVENTION

The present invention provides a pre-assembled, self-contained clean room module having all of the equipment necessary for maintaining the temperature, humidity and pressurization that are required for the work space within the room. Because the module is factory built rather than built on site, precise quality control can be achieved and each module can be thoroughly tested before shipment. This obviously is advantageous to the end user who can avoid the problems and inefficiencies of a field erected, one-of-a kind clean room.

An important feature of the invention, not found in any of the prior art cited above, is the provision in the module of its own sealed base unit. This base unit permits the module to be moved or relocated without having to be disassembled and also insures that the module will have a completely sealed sump area beneath its floor. Obtaining such a sealed area or plenum is difficult when the clean room is constructed or assembled on site.

Another important feature of the invention is the provision in the module of its own self-contained air conditioning unit which unit can be easily incorporated in the module as a whole. This unit has two independent air systems or paths whereby only a portion of the recirculating air need be conditioned as will be explained in greater detail hereinafter. This feature of the air conditioning unit saves energy and gives better operating control.

The principal object of this invention therefore is to provide a modular clean room, which will be a self-contained unit, with all the mechanical equipment necessary to control the air temperature, humidity, pressurization and cleanliness inside the space provided.

Another object of this invention is to provide a mobile modular clean room the base unit of which will include casters that can be cranked up and down to enable the invention to be rolled into position and set into place.

Another object of this invention is to provide a modular clean room which will be so designed as to meet or exceed the Federal Standard 209B for a Class 100 clean room. This means that there can be no more than 100 particles 0.5 microns in size and no more than four paricles of 2.0 microns in size per cubic foot.

A further object of this invention is to provide a modular clean room which will be so designed as to have its return floor plenum sealed underneath and epoxy coated to contain any chemical spills through the unit's perforated raised tiles.

Another object of this invention is to provide a modular clean room that can be moved or relocated as a complete unit, it only being necessary to disconnect electric, water and drain lines.

A still further object of this invention is to provide a modular clean room which employs a self-contained air conditioning unit that may be a component of the entire unit or separated for other uses.

Other objects are to provide a mobile modular clean room, which is simple in design, inexpensive to manufacture, rugged in construction, easy to use and efficient in operation.

Yet another object of this invention is to provide modular clean rooms which can be joined to one another to form a multiple unit clean room with a minimum of labor and without extensive or complex modifications.

It is still another object of this invention to provide such modular clean rooms whose air conditioning units can be connected together in a master/slave configuration to ensure uniform pressure, temperature, and humidity conditions in a multiple unit clean room.

These, and other objects, will be readily evident upon a study of the following specification and the accompanying drawings, wherein:

BRIEF DESCRIPTION OF THE DRAWINGS

FIG. 7 is a perspective view of a modified form of the invention, shown partly broken away;

FIG. 8 is a perspective view somewhat similar to FIG. 7, illustrating the side walls and the top partly broken away;

FIG. 9 is a perspective view of another modified form of the invention, illustrating a stand-alone air conditioner, which is optional;

FIG. 10 is a fragmentary perspective view of a further modified form of the invention, illustrating a composite grouping thereof;

DESCRIPTION OF THE PREFERRED EMBODIMENTS

Figure 6:
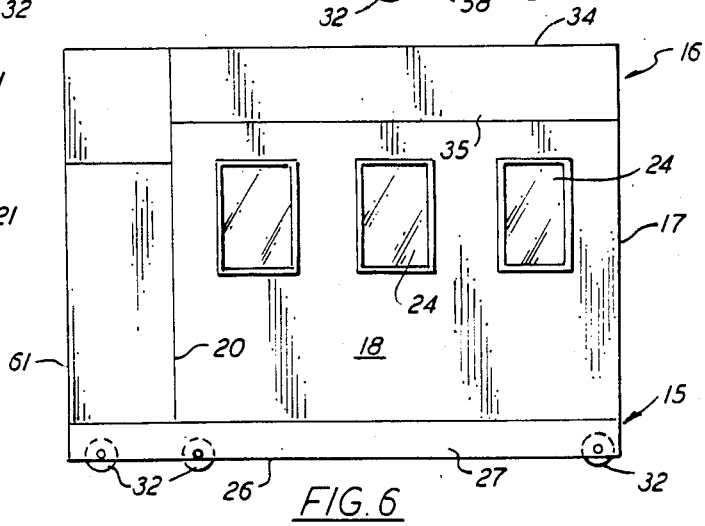
FIG. 6 is a front elevational view of FIG. 1.

Having reference now to the drawings, and with particular reference to FIGS. 1–4, the clean room module of the invention is essentially comprised of a base unit 15, a ceiling unit 16, a front wall 17, a side wall 18 and a back wall 20, FIG. 6, which abuts the inside panel or back wall of the air conditioning unit indicated generally at 21. An access door 22 is provided in the front wall 17 and, if desired, the side wall 18 can be provided with windows 24, FIGS. 1 and 6. The other side wall of the module can be formed by a panel shown fragmentarily at 25 in FIG. 1; however, if this side of the module is connected to a like module to provide a larger work space, the side will be left open for communication between the two as shown in FIG. 7.

The base unit 15, FIGS. 1–4, comprises a sheet metal bottom 26 and four sheet metal side walls 27 that are welded together to form a sealed box-like receptacle that serves as an air and water tight sump area. The module floor is comprised of perforated tiles 28, FIG. 1, that are spaced above the bottom 26 of the base unit and supported by transversely extending steel strips 30 that are in turn supported by truss-like members 31. Because the base unit is self-contained with its own sealed bottom and side walls, the complete module can be moved or relocated as required. To increase the mobility of the module, the base unit can be provided with casters 32 that can be raised or lowered by conventional crank means (not shown).

The ceiling unit 16, like the base unit 15, is essentially a hollow chamber or plenum, the unit including a top panel 34 to which are secured four depending side panels 35 in an airtight manner. A filter block 36 is spaced below the top panel 34 as best shown in FIG. 8 whereby a plenum chamber 37 is formed between the block and panel. The ceiling unit is entirely supported by four columns, one in each corner, such a column being shown at 38 in FIGS. 1, 7 and 8. With this construction, the side walls are not load bearing and can be removed as necessary when connecting two or more modules together.

Figure 1:
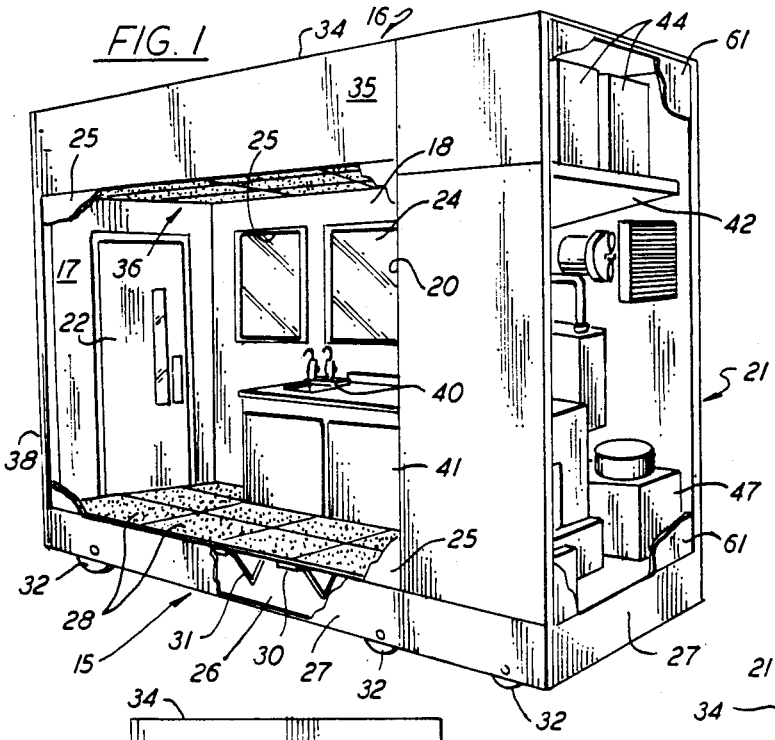
FIG. 1 is a perspective view of the present invention, shown partly broken away.

As indicated in FIG. 1, the interior of the module or work space may be provided with a sink 40, storage cabinets 41 or any other needed equipment.

The air conditioning unit 21, FIGS. 1, 2, 4 and 9, is an upstanding, self-contained unit which abuts the back wall 20 of the module interior. The top of the air conditioning unit is in communication with the ceiling unit plenum chamber 37 and the bottom of the unit is in communication with the interior of the base unit 15 as will be described in more detail hereinafter. A shelf 42 in the air conditioning unit supports recirculating fans 44 which are driven by a motor 45. These fans direct the recirculating air into the ceiling unit plenum 37 as shown by arrow 46, FIG. 4.

The air conditioning components are located below the shelf 42 and comprise a compressor 47, a condenser 48 and the make-up air components 49 including a make-up air fan 50, a reheat coil 51 and a DX coil 52, all to be described in more detail below. Also located in this area of the air conditioning unit are a humidifier 54, the power supply 55 and a controls recorder 56. Between the components just listed and the back wall of the air conditioning unit there is an enclosed vertical air duct 57, FIG. 4, through which return air from the base unit sump is drawn upwardly by the fans 44 as indicated by the arrows 58. The air duct is also in communication with the make-up air components 49 as indicated by the arrows 60.

Figure 2:
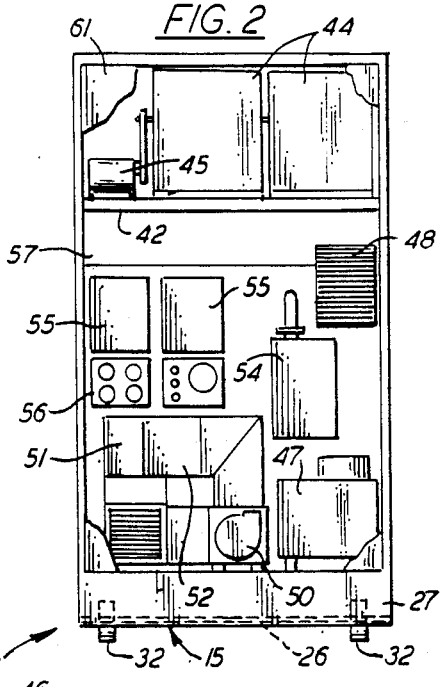
FIG. 2 is a diagrammatic end elevational view, taken from the right end of FIG. 1.
Figure 5:
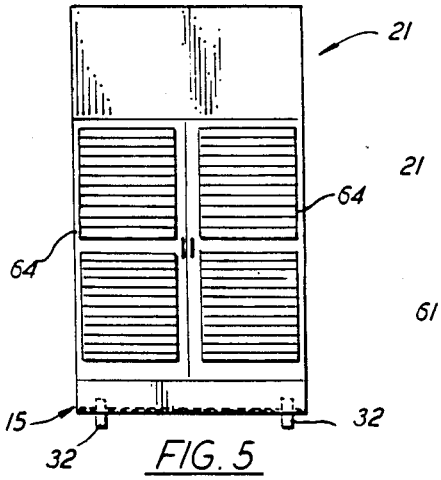
FIG. 5 is similar to FIG. 2, but is modified to include access or inspection covers.

The exposed side of the air conditioning unit 21 is normally closed by a wall or panel 61 shown in FIGS. 7 and 9 and fragmentarily in FIGS. 1 and 2. This wall has a smaller, removable panel 62 that permits access to the air conditioning components. Alternatively, the air conditioning unit can be provided with hinged, louvered access doors 64 as shown in FIG. 5.

Figure 3:
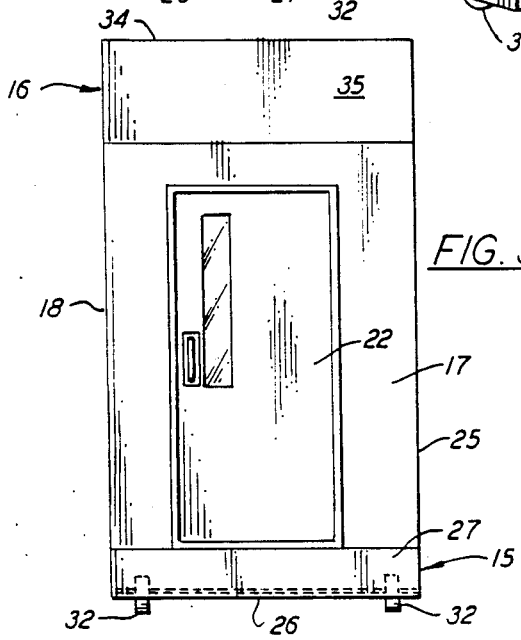
FIG. 3 is an end elevational view of the opposite end of FIG. 1.
Figure 4:
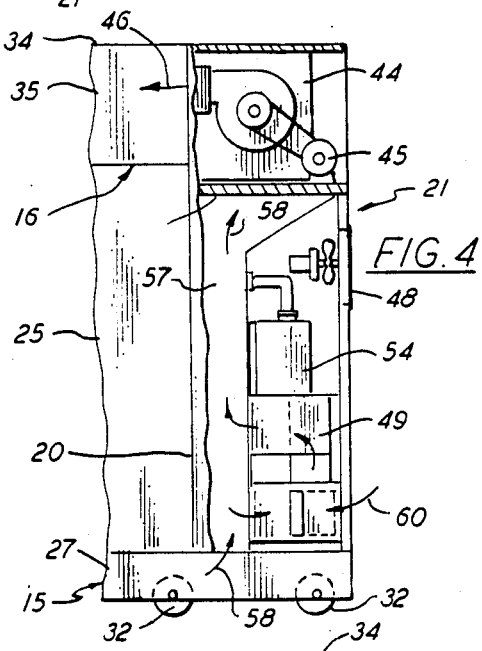
FIG. 4 is a fragmentary rear elevational view of FIG. 1, shown partly broken away.
Figure 11:
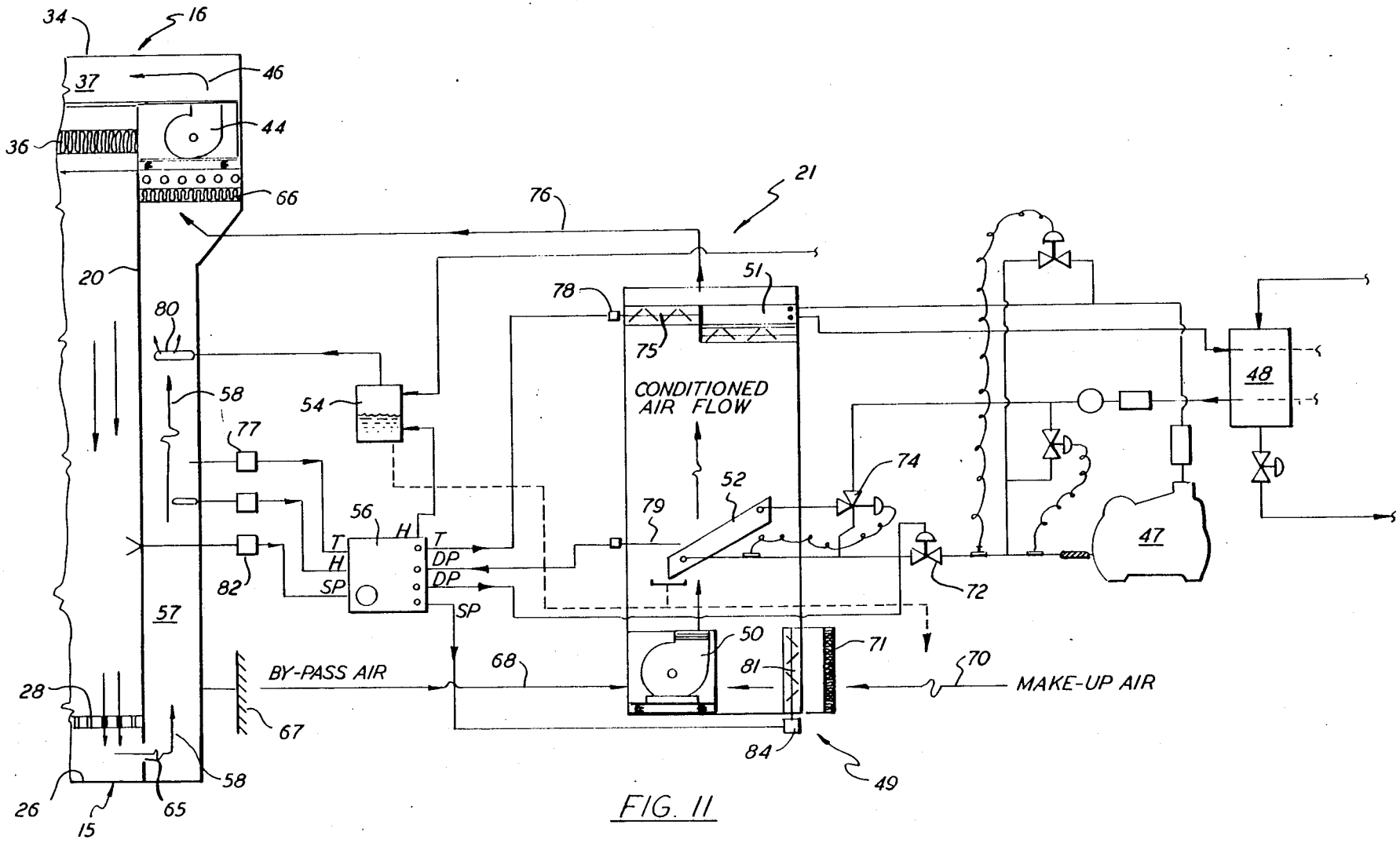
FIG. 11 is a schematic drawing illustrating the arrangement and operation of the air conditioning unit.

Reference is now made to FIG. 11 which is a schematic drawing that illustrates the operation of the air conditioning unit 21 and its relationship to the remainder of the clean room module. As indicated in FIGS. 1, 2 and 3, the air conditioning components are all actually located within the confines of the unit. In operation, the recirculating air is continuously blown through the interior of the clean room module by the fans 44, the air entering the ceiling unit plenum 37 and then passing down through the filter block 36 into the room. Because the air is under positive static pressure, it flows downwardly through the room in a vertical laminar flow. At the bottom of the room, the air passes through the floor tiles 28 and into the sump area of the base unit 15. From thence the air flows through an opening 65, FIG. 11, into the return air duct 57 which directs the air upwardly to the intake side of the fans 44. Before entering the fans, the air passes through recirculation prefilters 66.

As the air passes through the return air duct 57, a portion of it is drawn into the air conditioning system where it is combined with a certain amount of make-up air which, because of room exhaust and leakage, is needed to maintain room pressurization. This combined air flow is then blown through cooling and reheating coils by a make-up air fan. The conditioned air is then reinjected into the recirculating air stream.

The portion of the recirculating air that is drawn into the air conditioning system passes through a spring loaded, weighted backdraft damper 67 into a by-pass air conduit 68 that takes it to the make-up air fan 50. The make-up air enters the system through a conduit 70, passes through a prefilter 71, damper 81 and then is drawn into the fan 50 where it is combined with the by-pass air. The combined air flow is blown by the fan through the DX coil 52, the latter being a cooling coil that removes moisture from the make-up air. As shown in FIG. 11, the DX coil 52 is connected to the compressor 47 and condenser 48 through a suction throttling valve 72 and an expansion valve 74, respectively, the operation of all of these and other commercially available components being well known.

The combined air flow that passes through the DX coil 52 is thereafter blown in part through the reheat coil 51 and in part through by-pass dampers 75 on the coil depending on the temperature of the air, the control settings, etc. From the coil 51 and dampers 75, the conditioned, combined air flows into a conduit 76 that takes it back into the return air duct 57 just upstream of the prefilters 66 as shown, the conditioned air being injected into the recirculating air stream at this point.

The temperature in the clean room is controlled by the temperature of the air leaving the air conditioning system, just described. To this end, a dry bulb sensor 77, FIG. 11, is located in the return air duct 57, and this sensor transmits a signal to the controller 56 which signal is in proportion to the return air (room) temperature. This signal is analyzed by the controller with respect to the set point and the controller sends an output signal to a control element 78 on the by-pass dampers 75. By regulating the amount of conditioned air going through or bypassing the reheat coil 51, the leaving air temperature of the conditioned air flow is varied to meet the controller's set point condition.

The humidity in the clean air room is maintained by regulating the amount of moisture taken out of or added to the combined air stream. Thus, a sensor 79 located in the leaving air stream of the DX coil 52 sends a signal to the controller 56 which modulates the suction throttling valve 72 in the refrigeration lines to maintain setpoint. This setpoint is selected as the upper limit of the room dewpoint at saturated air conditions, i.e. so that dry bulb approximately equals wet bulb and dewpoint. The setpoint will control the refrigeration system to maintain maximum leaving air temperature and therefore the maximum amount of moisture in the air.

The steam generating humidifier 54, FIG. 11, adds moisture to the recirculating air stream thereby controlling the minimum level of humidity. Humidity sensor 80, through controller 56, controls humidifier 54 to add the proper amount of moisture for maintaining set point conditions. The range between minimum and maximum is termed the humidity tolerance. A relatively wide tolerance conserves energy because it allows the clean room humidity to float without refrigeration or steam energy. Closer tolerances require more energy. For a very close tolerance, the refrigeration must be set up to subcool the air slightly below the design dewpoint and then the steam humidifier 54 must continuously add moisture to hold the tolerance.

The pressurization in the clean air room is maintained by controlling the amount of make-up air that is drawn into the make-up air fan 50, FIG. 11, of the air conditioning unit. This air, as noted above, combines with a certain amount of by-pass air from the recirculating air stream to maintain a constant air flow through the DX refrigeration coil 52. This prevents frosting of the coil and loss of efficiency.

The amount of make-up air is regulated by a damper 81 that can be either manually or automatically controlled. A sensor 82 located in the clean air room immediately below the filter block 36 sends a pneumatic signal to a pressure gauge (not shown) located in the air conditioning unit and continuously indicates the room static pressure. The damper 81 can be manually set to any pressure. If automatic operation is desired, the pneumatic signal is also sent to the controller 56 which then automatically controls the make-up air damper 81 to hold set point by means of a damper motor 84.

The controller 56 is preferably an electronic unit that senses not only the room static pressure, but also the rate of change of the room static pressure. The controller 56 includes a continuously variable adjuster to move the make-up damper 81 in accordance with both the detected differential static pressure and the detected rate of change of static pressure. With this system, the differential pressure between inside and outside air is easily maintained within ±0.02 inch of water of the set point, typically ±0.10 inches WC.

Referring now to FIGS. 7 and 8, these drawings illustrate how two clean room modules can be joined to form a double unit having twice the work space of a single unit. The FIG. 7 module is, except for its base unit 15*a*, essentially like the module of FIGS. 1–4 having a ceiling unit 16*a*, a front wall 17*a*, a side wall 18*a* and a back wall 20*a* abutting the air conditioning unit 21*a*. The FIG. 8 module is in effect a mirror image of the FIG. 7 module so that the open back sides of the modules can be brought into registering engagement with each other to double the area of the work space.

As shown in FIGS. 7 and 8, the base units 15*a* and 15*b* of the mating modules are recessed at 85 and 86 respectively so that the modules can be "wrapped around" existing floor mounted fixtures or vibration isolated equipment such as electron beam units. Stated another way, an existing floor mounted fixture can be received in the space defined by the base unit recesses 85 and 86 which recesses can be shaped as required to fit around the particular fixture. With respect to FIGS. 7 and 8, it should also be noted that in this kind of an arrangement one module can be a master and the other module a slave meaning that the latter does not have its own air conditioning unit but receives its conditioned air from the master.

FIG. 9 illustrates the air conditioning unit as a free standing, independent unit 21*c* that can be utilized for other types of clean rooms or the like. The unit 21*c* includes a discharge duct 87, or the discharge duct may optionally be located at 88. Likewise, the return air duct may be located at 90 with knockout 91 being provided for an alternative return air connection. Knockout 92 is provided for supply air to adjacent units.

FIG. 10 illustrates a multiple module arrangement in which twelve clean room modules are connected together to form a relatively large clean room area. The drawing also illustrates the versatility of the modules since it shows the different ways in which they can be joined with one another. The multiple arrangement includes at least one access door 94 which may open into a gowning room 95. Windows 96 are provided as necessary, and for convenience one or more pass-throughs 97 can also be provided.

Figure 12:
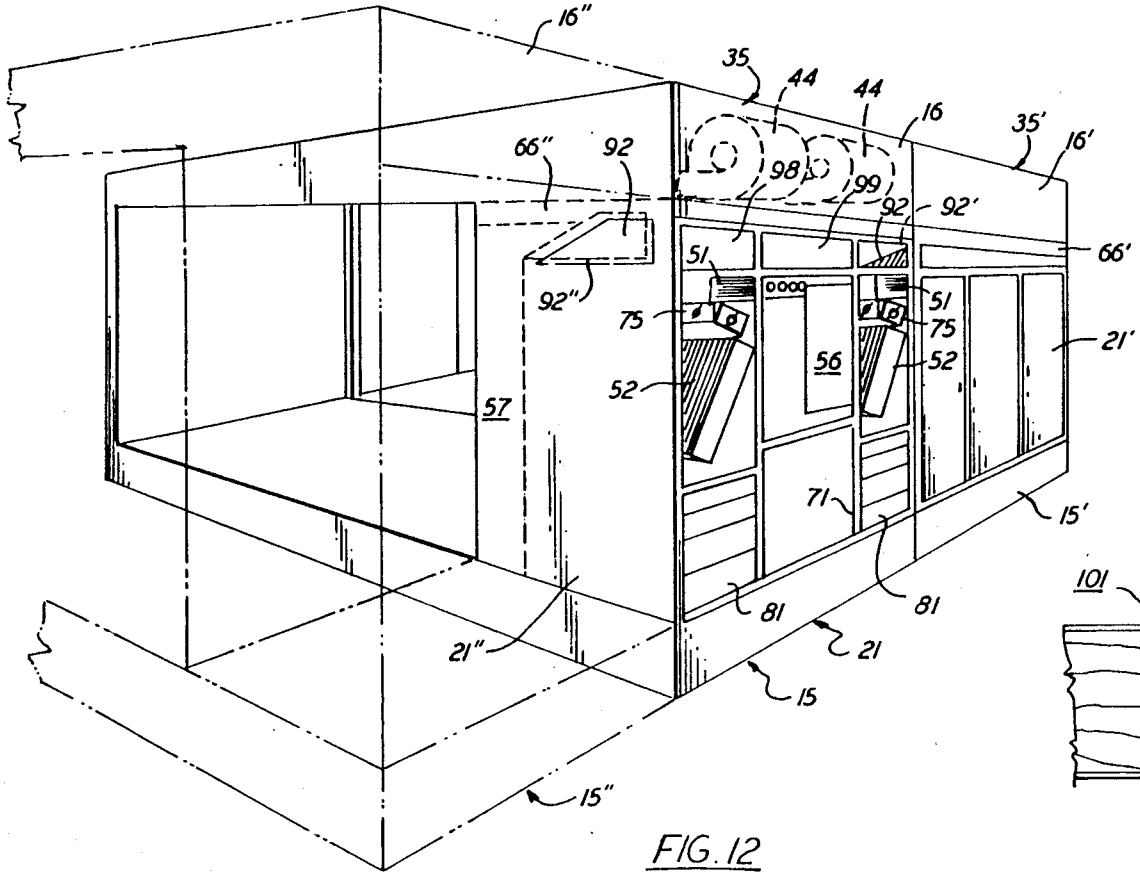
FIG. 12 is a perspective view, partly in ghost and partly cut away, of a group of modules of this invention configured in a master/slave arrangement.

FIG. 12 illustrates a multiple clean room assembly formed of three adjacent modules disposed side by side, with the central module functioning as master and the adjacent modules serving in a slave capacity. One of these modules (identified with double-primed reference numbers) is shown only in ghost lines so as to minimize drawing clutter. Here, the modules are joined with their air conditioning units 21, 21' and 21'' adjacent one another. The central module air conditioning unit is of dual coil configuration, with two DX coils 52, two reheat coils 51, two by-pass dampers 75, and two make-up air control dampers 81 defining two parallel air conditioning paths. These are both controlled by a single controller 56. The output side of the by-pass dampers 75 and reheat coils 51 feeds the output conditioned air into a generally wedge-shaped distribution chamber 98 that connects through an opening 99 at a central part of the air conditioning module into the return air conduit 57 where it flows through the prefilters 66 and thence into the main recirculating fans 44 which feed the recirculated air into the ceiling unit plenum 35. The wedge-shaped distribution chamber 98 also feeds the treated air through corresponding wedge-shaped openings (corresponding to knock-out 92), to the distribution chambers of the slave modules through corresponding wedge-shaped knock-out openings 92' and 92''. In this configuration only the central module air conditioning unit 21 (shown with cover removed) is used to dehumidify, cool, reheat, and control the pressure for all three modules. All three modules employ their own recirculating air systems to maintain the laminar vertical clean air flow in each module but the central or master module air conditioner 21 supplies the treated, temperature, humidity, and pressure controlled air to the main recirculating fans of all three modules. The control 56 of the central master air conditioner 21 only is functional.

In this arrangement the side wall panels 18 or 25 are removed from the central or master module, and one side wall panel 18 or 25 is removed from each of the slave modules, so that they can be joined. Gaskets disposed along the corner columns 38 and at the base and ceiling units 15, 16 compress together to form a seal when the modules are connected. Bolts or other fasteners can be passed between abutting side walls of adjacent ceiling and base units of the master and slave modules to connect the modules together. The slave module air conditioning unit 21' here is shown as a standard module with doors in place. A slave module does not contain any of the air treatment and make-up elements, but is provided with only the recirculating fans 44 and associated ducts and filters.

Figure 13:
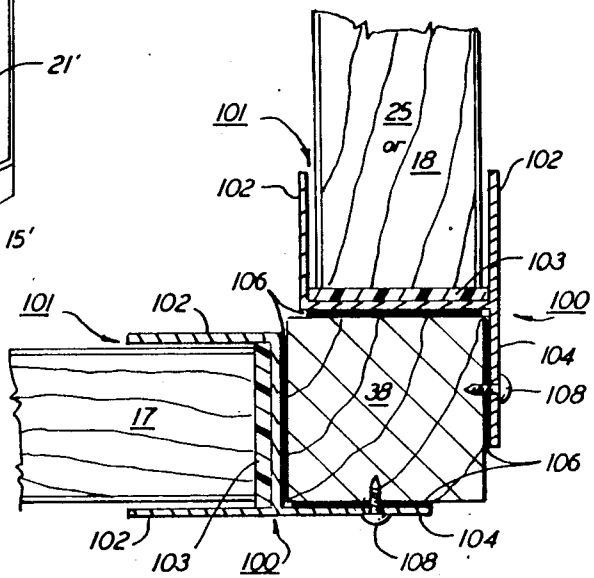
FIG. 13 is a sectional partial view of a corner post, side panel and end panel of the module of this invention.

The rigid side and front walls are removably connected to the corner columns 38 as generally shown in horizontal cross section in FIG. 13. Here the side wall panels 18 or 25 and the front panel 17 are each formed of a rigid panel and a surrounding mounting frame formed of an extruded aluminum "h"-shaped channel member 100. The panel 25 or 18 itself fits into a channel 101 defined between two flanges 102 and abuts a gasket 103 to form a sealed entity. An outer flange 104 then projects around the periphery of the column 38, and is fastened against the column 38 with a gasket 106 compressed between the channel 100 and the cloumn 38. These elements are easily fastened together with machine screws 108. The top edge and bottom edge of the panels 25, 18 and 17 are fastened to the module base unit 15 and ceiling unit 16 in similar fashion. When two or more modules are to be combined, it is a simple matter to unscrew the facing panels and join the modules together with the panels removed. Because the panels are not load bearing, the modules maintain their structural integrity when one or more panels are removed, so the modules can be moved together on their casters, with their panels removed, to facilitate their combination.

The air conditioning circuit including the make-up air fan 50, the DX coil 52, the reheat coil 51 and by-pass damper 75 and return duct 98 or conduit 76 handles a constant volume of air per unit time, the volume being the sum of by-pass air 68 plus make-up air 70. This volume constitutes only a fraction of the total recirculated air, typically, between 5% and 20%. Because only a small part of the total circuiated air passes through this loop, the DX coil 52 can cool at full capacity for more efficient operation; the coil 52 need not be held at the much higher room interior dry bulb temperature but can be much cooler. Another benefit of the partial recirculation of the air is the ability to hold room temperature (typically ±0.1 to ±0.4 degrees F.), even with the DX coil temperature variance ranging ±2.0 degrees F. or more.

Preferably, the reheat coil 51 receives its heat from the heat absorbed in the DX coil 52. This avoids the need for a separate electric heater.

The modular clean room of this invention has the advantage of being factory assembled, pre-packaged and pre-tested. The modular unit can be simply connected to electric, water, and drain and turned on ready for use. If there is any residual dust, it will purge out in a short interval of time. Field certification is usually unnecessary, depending on local regulations, because the built-in air conditioning is pre-tested and factory certified. Modules constructed according to this invention have been found to exceed federal quality standard 209 B for a class 100 and better clean room, and have consistently met class 10 standard (i.e., less than ten particles of ½ micron diameter per cubic foot, with no particles larger than five microns).

Temperature is maintained within ±0.1 degree F., humidity maintained within ±2.0% RH, and pressure maintained within ±0.02 inches of water column of the desired set point.

Also, because the clean rooms are transportable and modular, and not field-assembled, they can be treated as capital expenditures by the purchaser, and are ideal for lease arrangements.

From the foregoing description it will be apparent the invention provides a novel and very advantageous clean room module. As will be apparent to those familiar with the art, the invention may be embodied in other specific forms without departing from the spirit or essential characteristics thereof.

I claim:

1. A clean room module comprising in combination a self-contained, unitary base unit including a floor, the base unit having a bottom and side walls that together define a sealed sump chamber beneath the floor; vertical side walls mounted on and supported by the base unit; an upstanding, self-contained air conditioning unit connected to the base unit adjacent one side wall of the clean room module; a ceiling unit in engagement with the upper edges of the side walls; means for supporting the ceiling unit independently of the side walls, the ceiling unit having filter material therein and a plenum chamber above the filter material; the floor, side walls and ceiling unit defining an enclosed clean room area; the ceiling unit plenum chamber and the base unit sump chamber being in communication with the air conditioning unit; said air conditioning unit having a first circulating path for moving the air from said base unit sump chamber to said ceiling unit plenum chamber, and a second circulating path including an automatically controllable diverter for diverting a part of the air of said base sump unit chamber from the first path, a blower having an intake coupled to said diverter, a make-up air inlet coupled to the intake of the blower and including a controllable make-up damper, air conditioning means following said blower for treating the diverted air and make-up air, and distribution means following said air conditioning means for injecting the treated air into said first circulating path, said second path handling a constant volume per unit time of flow formed of the sum of the diverted and make-up air flows, and static pressure control sensor means for controlling said make-up damper in accordance with the static pressure in said enclosed clean room area so that the air conditioning unit circulates filtered air at a constant predetermined pressure in a downward laminar flow through the enclosed clean room area.

2. A clean room module as defined in claim 1 wherein the base unit includes a plurality of casters at the bottom thereof to enhance the mobility of the module.

3. A clean room module as defined in claim 1 wherein the side walls include coacting, interlocking means for providing an air and vapor tight seal between adjacent walls.

4. A clean room module as defined in claim 1 wherein said means for supporting the ceiling unit independently of said side walls includes corner columns disposed at the corners of said module clean room area, said side walls including a rigid panel and frame disposed over the periphery of said panel and having a flange sealably fitting against said corner columns and said ceiling unit and said base unit; and further comprising fastening means for removably fastening said flange to said columns.

5. A clean room module as defined in claim 4 wherein said frame comprises an extruded aluminum channel.

6. A clean room module as defined in claim 4, further comprising a flat gasket member on said column compressed between the column and the flange of said frame.

7. A clean room module as defined in claim 1, wherein said distribution means includes a distribution channel extending laterally and having a port disposed in at least one side wall of the air conditioning unit, the port serving for coupling by a corresponding port to a distribution channel of an air conditioning unit of an adjacent connected clean room module for supplying the treated air from the first-mentioned clean room module to the first circulating path of the second-mentioned clean room module, so that the first-mentioned module functions as a master and the second-mentioned module acts as a slave unit receiving treated air only from the air conditioning unit of the first-mentioned module.

8. A clean room module as defined in claim 1 wherein said second circulating path is disposed to one side of the air conditioning unit, and the latter includes a third circulating path disposed to the other side thereof, and having an automatically controllable diverter, a blower having an input coupled to the diverter, a make-up air inlet coupled to the intake of the blower and including a controllable make-up damper, air conditioning means following said blower, and means coupling the air conditioning means to said distribution means, said sensor means controlling the make-up damper of the third circulating path as well as the make-up damper of the second circulating path.

9. For use with a clean room module or the like: a self-supporting, self-contained air conditioning unit including a first fan for blowing recirculating air into a room or area to be air conditioned; a return air duct having an intake port for receiving the recirculating air after it has passed through the room, the duct being operable to deliver the air to the first fan; the room to be air conditioned and the return air duct defining a first air circuit for the air conditioning unit; a second fan operating at constant volume flow between about five and twenty percent of the air flow through the first air circuit; means including a make-up air damper for delivering ambient, make-up air to the second fan; bypass means coacting with the return air duct in advance of the first fan for diverting a portion of the air passing therethrough into the second fan; an enclosure for the second fan forming a part of the air conditioning unit; a cooling coil and a reheat coil in the enclosure; the second fan being operable to mix the make-up air and the air diverted from the duct and blow the combined air through the cooling and reheat coils to condition same; means for delivering the conditioned air back to the return air duct for combining with the recirculating air passing therethrough; the by-pass means, the second fan enclosure, and the means for delivering conditioned air back to the duct defining a second air circuit for the air conditioning unit; and controller including an air pressure sensor in communication with said room or other area and a damper control for controlling said make-up air damper in accordance with the air pressure in said room or area and with the rate of change of air pressure in said room or area so as to maintain said room or area at a substantially constant pressure.

10. An air conditioning unit as defined in claim 9 wherein the return air duct is substantially vertically disposed, the first fan being located adjacent the upper end of the duct and the duct intake port being located adjacent the lower end of the duct whereby the return air flows upwardly from the port to the fan.

11. An air conditioning unit as defined in claim 10 together with prefiltering means in the duct adjacent the upstream side of the first fan.

12. An air conditioning unit as defined in claim 10 wherein the means for diverting a portion of the duct air to the second fan is located adjacent the lower end of the duct.

13. An air conditioning unit as defined in claim 11 wherein the means for delivering the conditioned air back to the duct connects with the duct adjacent the upstream side of the prefiltering means.

* * * * *